US006354176B1

(12) United States Patent
Nordlin

(10) Patent No.: US 6,354,176 B1
(45) Date of Patent: Mar. 12, 2002

(54) UNIVERSAL DEEP SOCKET AND ADAPTER

(75) Inventor: William F. Nordlin, Rockford, IL (US)

(73) Assignee: Greenlee Textron, Inc., Rockford, IL (US)

( * ) Notice: Subject to any disclaimer, the term of this patent is extended or adjusted under 35 U.S.C. 154(b) by 0 days.

(21) Appl. No.: 09/709,818

(22) Filed: Nov. 10, 2000

(51) Int. Cl.[7] ..... B25B 13/00
(52) U.S. Cl. ..... 81/124.4; 81/125.1; 81/121.1
(58) Field of Search ..... 81/121.1, 124.3, 81/124.4, 124.6, 124.7, 125.1, 177.2, 177.85

(56) References Cited

U.S. PATENT DOCUMENTS

| | | | | | |
|---|---|---|---|---|---|
| 151,635 | A | * | 6/1874 | Uhlinger et al. | 81/124.3 |
| 2,651,230 | A | * | 9/1953 | Waterval | 81/124.3 |
| 4,646,594 | A | * | 3/1987 | Tien | 81/121.1 |
| 4,774,736 | A | * | 10/1988 | Brawner et al. | 81/124.4 |
| 5,048,379 | A | * | 9/1991 | Gramera et al. | 81/124.4 |
| 5,186,083 | A | * | 2/1993 | Hsiao | 81/124.4 |
| 5,219,392 | A | * | 6/1993 | Ruzicka et al. | 81/124.3 |
| 5,595,096 | A | * | 1/1997 | Coffman | 81/121.1 |
| 6,112,625 | A | * | 9/2000 | Turtle | 81/177.2 |

OTHER PUBLICATIONS

Three (3) Product sheets published by Lowell Corporation at least as early as May 24, 2000.

* cited by examiner

*Primary Examiner*—Eileen P. Morgan
*Assistant Examiner*—Joni B. Danganan
(74) *Attorney, Agent, or Firm*—Trexler, Bushnell, Giangiori, Blackstone & Marr, Ltd.

(57) ABSTRACT

A deep socket which has two ends, where each end is configured to engage a pair of different sized nuts. Preferably, one end of the deep socket is configured to engage either a ¾ inch or 13⁄16 inch square nut, and the other end of the deep socket is configured to engage either a 1 inch or 1-and-⅛ inch square nut. Preferably, the deep socket is configured such that the deep socket can be used to turn a nut fully down on a threaded rod which extends up to eight inches including a nut on the threaded rod. Preferably, the socket includes a body that provides a bore that is configured to accept the threaded rod when the socket is used to turn the nut down on the threaded rod. Preferably, each end of the socket is configured to be engaged with a ¾ inch square adapter. Ideally, each end is configured to engage a spring pin locking mechanism which is provided on the adapter such that the socket tends to remain engaged with the adapter. The adapter may be of the hex drive type, or may be configured for a square drive, such as a ½ inch square drive. Preferably, the adapter is configured such that the socket can be driven using conventional hydraulic, air or electric rotary tools, such as with a hydraulic gun, an air gun or an electric drill.

11 Claims, 3 Drawing Sheets

UNIVERSAL DEEP SOCKET AND ADAPTER

BACKGROUND

The present invention relates generally to sockets and adapters, and relates more specifically to a universal deep socket which is configured to mate with a plurality of different nut sizes and to an adapter which is configured to engage the socket so the socket can be driven using a tool of some type.

Socket sets are widely commercially available where each socket in the set is a different size, i.e. each socket is configured to be used for a different sized nut. For example, one socket may be configured to engage a ¾ inch square nut, while other sockets in the set are configured to engage other sized nuts, such as a 11/16 inch square nut, a 1 inch square nut, a 1 and ⅛ inch square nut, and possibly nuts of other shapes and sizes. Of course, the fact that the socket set includes so many sockets means that there is a substantial chance that one of the sockets in the set can get lost. If a socket in the set becomes lost, the set cannot generally be used to turn a nut of the size which corresponds to the lost socket. Additionally, because a worker must select the correct sized socket from the socket set in order to turn a given sized nut, using such a socket set is not very convenient.

In some applications, a nut must be spun down on (i.e. driven onto) a long threaded rod. Such an application exists in the electric utility market wherein brackets are fastened to utility poles using threaded rods. Because of the variation in the diameters of the poles and variation in the thicknesses and styles of the brackets, the threaded rods often extend well beyond the brackets, making it impossible to fully spin the nut down using a standard socket or even a standard deep socket. While a manual ratchet wrench such as those which are commercially available from the Lowell Corporation, located in W. Boylston, Mass., provides an improvement over a box wrench or crescent wrench and can be used in such an application where a nut must be spun down on a long threaded rod, such wrenches are hand operated and are not configured to be driven using a power tool, such as with a hydraulic gun, an air gun or an electric drill. Using a power tool to drive the nut down on the threaded rod provides that the work can be performed faster and that more torque can be applied to the nut, with less operator fatigue.

OBJECTS AND SUMMARY

An object of an embodiment of the present invention is to provide a universal type socket which is configured to be used with a plurality of different sized nuts.

Another object of an embodiment of the present invention is to provide a socket which has two ends where each end is configured to be used with a plurality of different sized nuts.

Still another object of an embodiment of the present invention is to provide a socket which has two ends where each end is configured to be used with a pair of different sized nuts.

Still yet another object of an embodiment of the present invention is to provide a deep socket including an internal bore of sufficient length such that the deep socket can be used to turn a nut fully down on a threaded rod which extends up to eight inches including the nut.

A further object of an embodiment of the present invention is to provide a deep socket which is configured to be used with a plurality of different sized nuts.

Yet a further object of an embodiment of the present invention is to provide a deep socket which has two ends where each end is configured to be used with a plurality of different sized nuts.

Yet still a further object of an embodiment of the present invention is to provide a deep socket which has two ends where each end is configured to be used with a pair of different sized nuts.

Yet another object of an embodiment of the present invention is to provide a deep socket which is configured to be driven using a tool, such as with a hydraulic gun, an air gun or an electric drill.

Yet another object of an embodiment of the present invention is to provide an adapter which is configured to engage the socket of the present invention.

Briefly, and in accordance with at least one of the foregoing objects, a preferred embodiment of the present invention provides a deep socket which has two ends, where each end is configured to engage a pair of different sized nuts. Preferably, one end of the deep socket is configured to engage either a ¾ inch or 13/16 inch square nut, and the other end of the deep socket is configured to engage either a 1 inch or 1-and-⅛ inch square nut. Preferably, the deep socket is configured such that the deep socket can be used to turn a nut fully down on a threaded rod which extends up to eight inches including the nut.

Preferably, each end of the socket is configured to be engaged with a ¾ inch square driver or adapter as will be explained more fully later herein. Ideally, each end is configured to engage a spring pin locking mechanism which is provided on the adapter such that the socket tends to remain engaged with the adapter. The adapter may be of the hex drive type, or may be configured for a square drive, such as a ½ inch square drive. Preferably, the adapter is configured such that the socket can be driven using conventional hydraulic, air or electric rotary tools, such as with a hydraulic gun, an air gun or an electric drill.

BRIEF DESCRIPTION OF THE DRAWINGS

The present invention and the advantages thereof will become more apparent upon consideration of the following detailed description when taken in conjunction with the accompanying drawings of which.

DESCRIPTION

Figure 1:
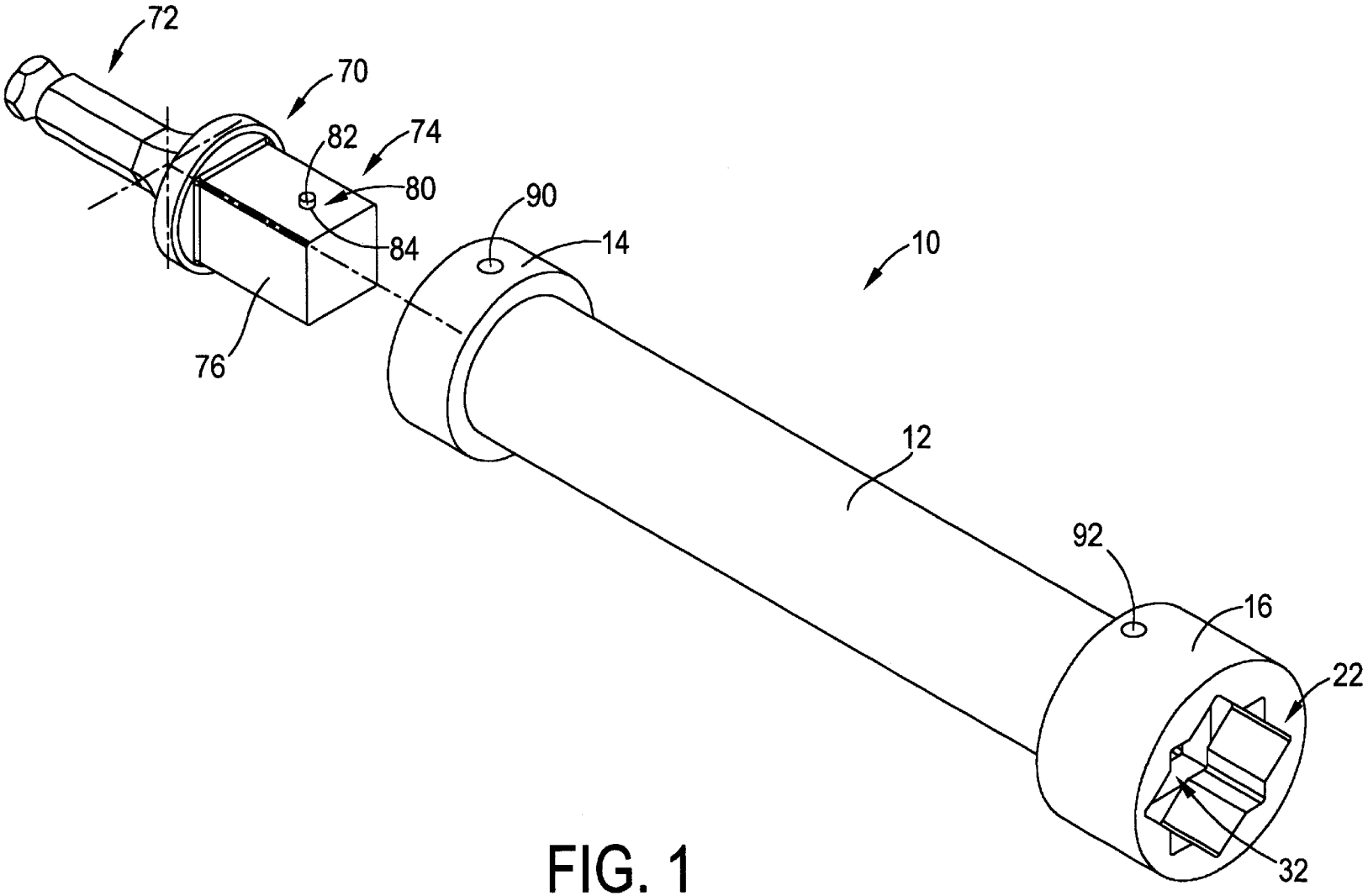
FIG. 1 is a perspective view of a deep socket which is in accordance with an embodiment of the present invention, and an adapter which is configured to engage the socket so the socket can be driven using conventional tools.

While the present invention may be susceptible to embodiment in different forms, there is shown in the drawings, and herein will be described in detail, an embodiment with the understanding that the present description is to be considered an exemplification of the principles of the invention and is not intended to limit the invention to that as specifically illustrated and described herein.

Illustrated in FIGS. 1–6 is a deep socket 10 which is in accordance with an embodiment of the present invention. The socket 10 is "universal" in that it is configured to be used with a plurality of different sized nuts. Preferably, the socket 10 is configured as a deep socket which can be used to turn a nut fully down on a threaded rod which extends up to eight inches including the nut. The deep socket 10 is preferably configured to be driven using a conventional hydraulic, air or electric rotary tool, such as a hydraulic gun, an air gun or an electric drill.

Figure 5:
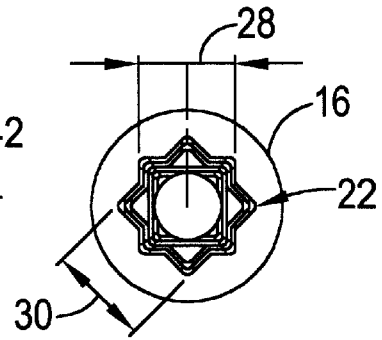
FIG. 5 is a view of the other end (i.e. the right end as shown in FIG. 3) of the deep socket illustrated in FIG. 1.
Figure 3:
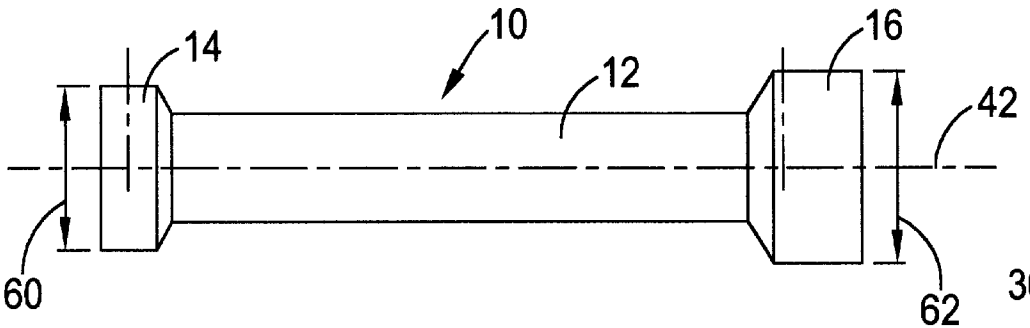
FIG. 3 is a side view of the deep socket illustrated in FIG. 1.
Figure 4:
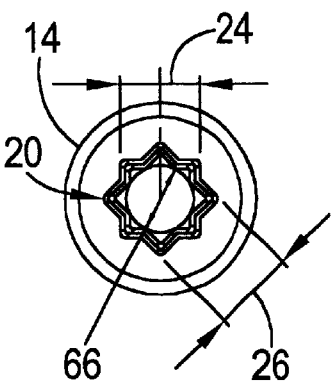
FIG. 4 is a view of one of the ends (i.e. the left end as shown in FIG. 3) of the deep socket illustrated in FIG. 1.

Specifically, as shown in the FIGURES, the deep socket 10 includes a middle body portion 12 and two ends 14 and 16, where each end of the deep socket 10 is configured to engage two different sized nuts. Preferably, a first end 14 of the deep socket 10 is configured to engage either a ¾ inch or 13/16 inch square nut, and a second, opposite end 16 of the deep socket 10 is configured to engage either a 1 inch or 1-and-⅛ inch square nut. As shown in FIGS. 1, 4 and 5, to provide that each end 14 and 16 of the deep socket 10 can engage two different sized square nuts, preferably each end 14, 16 of the deep socket 10 is provided with a generally star-shaped opening 20, 22, wherein the star-shape results from overlapping square-shaped recesses. As shown in FIG. 4, preferably one end 14 of the deep socket 10 has a generally star-shaped opening 20 consisting of a 0.781 inch square 24 for engaging a ¾ inch square nut and an overlapping 0.844 inch square 26 for engaging a 13/16 inch square nut. As shown in FIG. 5, preferably the other end 16 of the deep socket 10 has a generally star-shaped opening 22 consisting of a 1.031 inch square 28 for engaging a 1 inch square nut and an overlapping 1.156 inch square 30 for engaging a 1-and-⅛ inch square nut. Of course, the ends 14, 16 of the deep socket 10 may be configured to engage nuts having sizes other than ¾ inch, 13/16 inch, 1 inch and 1-and-⅛ inches. Additionally, the ends 14, 16 of the deep socket 10 may be configured to engage nuts which have a shape other than square.

Figure 6:
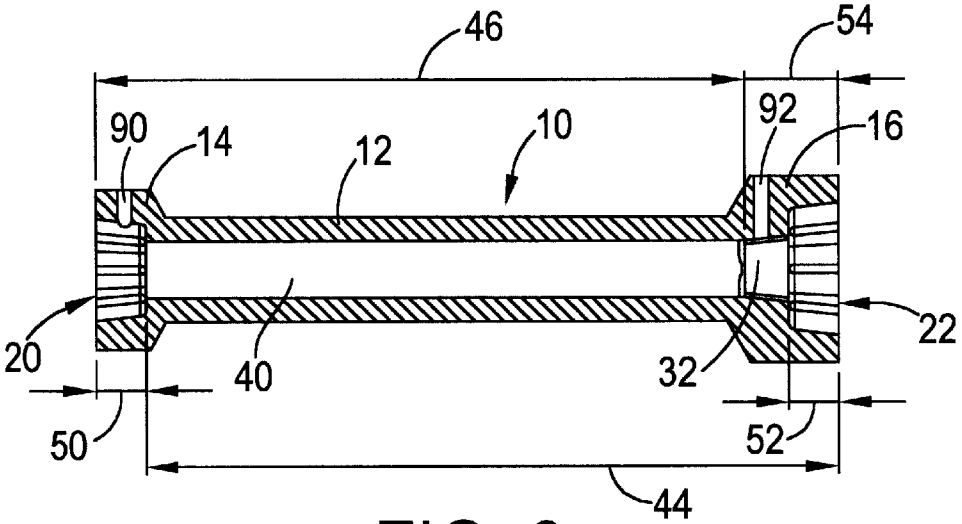
FIG. 6 is a cross-sectional view of the deep socket illustrated in FIG. 1, taken along line 6—6 of FIG. 2.

As shown in FIG. 6 (and partially in FIG. 1), preferably end 16 of the deep socket 10 also includes a driver or adapter recess 32, wherein the driver recess 32 is configured to receive a driver member. Specifically, the driver recess 32 is preferably a 0.781 inch square recess for engaging a ¾ inch square driver member. As such, if end 14 of the deep socket 10 is going to be used to turn either a ¾ inch or 13/16 inch square nut, a ¾ inch driver member can be engaged with the other end 16, in the driver recess 32. On the other hand, if end 16 of the deep socket 10 is going to be used to turn either a 1 inch or 1-and-⅛ inch square nut, a ¾ inch driver member can be engaged with the other end 14, in the 0.781 inch square recess 24.

As also shown in FIG. 6, preferably the deep socket 10 includes a through bore 40 which extends along the longitudinal axis 42 (see FIG. 3) of the deep socket 10, generally from one end 14 of the deep socket 10 to the other (16), generally along the central axis 42 of the middle body portion 12. The through bore 40 provides that the deep socket 10 can receive a threaded shaft or bolt while the deep socket 10 is being used to turn or thread a nut onto the threaded shaft or bolt. As discussed above, the deep socket 10 is preferably configured such that it can be used to turn a nut fully down on a threaded rod which extends up to eight inches including the nut. Hence, dimensions 44 and 46 as shown in FIG. 6 are preferably greater than or equal to eight inches.

Preferably, the overall length of the deep socket 10 is approximately 9.5 inches, and dimensions 50 and 52 are each approximately 0.625 inches. Preferably, dimension 54 is approximately 1.250 inches, dimension 60 (see FIG. 3) is approximately 2.063 inches and dimension 62 (see FIG. 3) is approximately 2.375 inches. The through bore 40 may be approximately 0.765 inches in diameter (dimension 66 in FIG. 4). Preferably, the deep socket 10 is formed of metal, such as iron or steel, and has no sharp corners on its exterior surface.

As discussed above, each end 14, 16 of the deep socket 10 may be configured to be engageable with a ¾ inch square driver member. Specifically, the driver member may be an adapter 70 as illustrated in FIG. 1. As shown, the adapter 70 includes an end 72 designed to be engaged by a power operated drive tool or hand operated tool, and is referred to as the driver-engaging end 72. In addition, the adapter 70 includes a socket-engaging end 74. As shown in FIG. 1, the driver-engaging end 72 of the adapter 70 may be configured to engage a hex driver (wherein the adapter is a "hex drive adapter"). Alternatively, the driver-engaging end 72 of the adapter 70 may be configured to engage a square driver (wherein the adapter is a "square drive adapter"), such as a ½ inch square driver. As shown, the socket-engaging end 74 of the adapter preferably provides a square shaped member 76 for engaging either end 14 or 16 of the deep socket 10. The square shaped member 76 provided by the adapter 70 may be a ¾ inch square which can be engaged in the 0.781 inch square recesses 24 or 32 provided in either end 14 or 16 of the deep socket 10.

Figure 2:
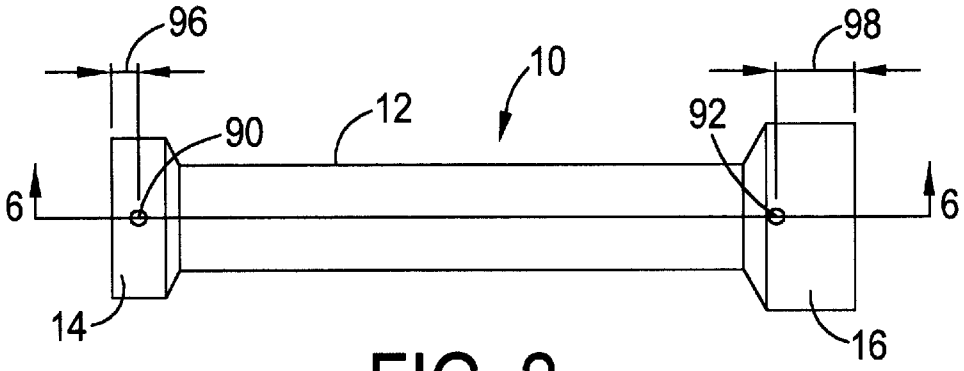
FIG. 2 is a top view of the deep socket illustrated in FIG. 1.

As shown in FIG. 1, preferably the socket-engaging end 74 of the adapter 70 provides a spring pin locking mechanism 80 for generally locking the adapter 70 into engagement with either end 14 or 16 of the deep socket 10. The spring pin locking mechanism 80 may include a plunger 82 which is depressible into a hole 84 in the adapter, and a spring and detent plug (neither of which are shown) which are disposed in the hole 84 to support the plunger 82. As shown in FIGS. 1, 2 and 6, preferably holes 90 and 92 are provided proximate each end 14 and 16 of the socket 10 for cooperating with a spring pin locking mechanism, such as with the plunger 82 of the spring pin locking mechanism 80 of the adapter 70 shown in FIG. 1. Preferably, dimension 96 in FIG. 2 is approximately 0.375 inches and dimension 98 is approximately 1.000 inch, wherein dimension 98 is larger than dimension 96 because of the driver recess 32 provided in the end 16 of the socket 10.

Preferably, the deep socket 10 and adapter 70 are configured such that the adapter 70 and deep socket 10 and can be driven using a conventional hydraulic, air or electric rotary tool, such as a hydraulic gun, an air gun or an electric drill.

While an embodiment of the present invention is shown and described, it is envisioned that those skilled in the art may devise various modifications of the present invention without departing from the spirit and scope of the appended claims.

What is claimed is:

1. A socket which is configured to engage a ¾ inch square nut, a 13/16 inch square nut, a 1 inch square nut, and a 1-and-⅛ inch square nut, and is configured to be driven using a ¾ inch square driver, said socket comprising: a body having a first end and a second end, wherein said first end provides a first star-shaped opening consisting of a ¾ inch square and a 13/16 inch square, wherein said second end provides a second star-shaped opening consisting of a 1 inch square and a 1-and-⅛ inch square, and a recess in said body, in communication with said second star-shaped opening, which provides a ¾ inch square opening for receiving the ¾ inch square driver.

2. A socket as recited in claim 1, wherein the body of the socket includes a through bore extending from said recess to said first star-shaped opening.

3. A socket as recited in claim 2, wherein the body is at least eight inches long.

4. A socket as recited in claim 1, further comprising a first hole in said body, wherein said first hole is proximate said first end of said body and is in communication with said first star-shaped opening, and a second hole in said body, wherein said second hole is proximate said second end of said body and is in communication with said recess.

5. A socket which is configured to engage a plurality of different sized nuts, said socket comprising: a body having a first end and a second end, wherein said first end provides a first opening configured to engage a plurality of different sized nuts, and wherein said second end provides a second opening configured to engage a plurality of different sized nuts, a recess in said body, in communication with said second opening, configured to receive driving structure, wherein said recess is sized to receive driving structure which is generally the same size as one of the nuts said socket is configured to engage in said first and second end.

6. A socket which is configured to engage a plurality of different sized nuts, said socket comprising: a body having a first end and a second end, wherein said first end provides a first opening configured to engage a plurality of different sized nuts, and wherein said second end provides a second opening configured to engage a plurality of different sized nuts, a recess in said body, in communication with said second opening, configured to receive driving structure, wherein said first opening comprises a star-shaped opening consisting of a first square and a second square, wherein said second opening comprises a star-shaped opening consisting of a third square and a fourth square, wherein said recess which is in communication with said second opening comprises a square-shaped opening consisting of a fifth square, wherein said fifth square is generally the same size as said first square.

7. A socket as recited in claim 6, wherein said first square provides that said first end is configured to engage a ¾ inch square nut, wherein said second square provides that said first end is configured to engage a 13/16 inch square nut, wherein said third square provides that said second end is configured to engage a 1 inch square nut, wherein said fourth square provides that said second end is configured to engage a 1-and-⅛ inch square nut, and wherein said fifth square provides that said recess is configured to engage ¾ inch driving structure.

8. A socket which is configured to engage a plurality of different sized nuts, said socket comprising: a body having a first end and a second end, wherein said first end provides a first opening configured to engage a plurality of different sized nuts, and wherein said second end provides a second opening configured to engage a plurality of different sized nuts, a recess in said body, in communication with said second opening, configured to receive driving structure, wherein said first opening consists of a first shape and a second shape, wherein said second opening consists of a third shape and a fourth shape, wherein said recess which is in communication with said second opening consists of a fifth shape, wherein said fifth shape is generally the same as said first shape.

9. A socket which is configured to engage a plurality of different sized nuts, said socket comprising: a body having a first end and a second end, wherein said first end provides a first opening configured to engage a plurality of different sized nuts, and wherein said second end provides a second opening configured to engage a plurality of different sized nuts, a recess in said body, in communication with said second opening, configured to receive driving structure, wherein the body of the socket includes a through bore extending from said recess to said first opening.

10. A socket as recited in claim 9, wherein the body is at least eight inches long.

11. A socket which is configured to engage a plurality of different sized nuts, said socket comprising: a body having a first end and a second end, wherein said first end provides a first opening configured to engage a plurality of different sized nuts, and wherein said second end provides a second opening configured to engage a plurality of different sized nuts, a recess in said body, in communication with said second opening, configured to receive driving structure, further comprising a first hole in said body, wherein said first hole is proximate said first end of said body and is in communication with said first opening, and a second hole in said body, wherein said second hole is proximate said second end of said body and is in communication with said recess.

* * * * *